US009376185B2

(12) United States Patent
Hawkes et al.

(10) Patent No.: US 9,376,185 B2
(45) **Date of Patent: *Jun. 28, 2016**

(54) INTERNAL WINCH FOR SELF PAYOUT AND RE-WIND OF A SMALL DIAMETER TETHER FOR UNDERWATER REMOTELY OPERATED VEHICLE

(75) Inventors: Graham Hawkes, San Anselmo, CA (US); Charles Chiau, Milpitas, CA (US); Adam Wright, San Anselmo, CA (US)

(73) Assignee: Bluefin Robotics Corporation, Quincy, MA (US)

( * ) Notice: Subject to any disclaimer, the term of this patent is extended or adjusted under 35 U.S.C. 154(b) by 237 days.

This patent is subject to a terminal disclaimer.

(21) Appl. No.: 13/559,271

(22) Filed: Jul. 26, 2012

(65) Prior Publication Data

US 2013/0193256 A1 Aug. 1, 2013

Related U.S. Application Data

(60) Provisional application No. 61/512,537, filed on Jul. 28, 2011.

(51) Int. Cl.

| | |
|---|---|
| ***B63G 8/00*** | (2006.01) |
| ***B65H 49/04*** | (2006.01) |
| ***B65H 75/42*** | (2006.01) |
| ***B65H 75/44*** | (2006.01) |

(52) U.S. Cl.

CPC *B63G 8/001* (2013.01); *B63G 8/00* (2013.01); *B65H 49/04* (2013.01); *B65H 75/425* (2013.01); *B65H 75/4484* (2013.01); *B65H 2701/32* (2013.01)

(58) Field of Classification Search

CPC .... B63B 21/66; B63B 35/815; B63B 35/816; B63B 8/00; B63B 8/001; B63B 8/38; B63B 8/39; B65H 49/04; B65H 75/425; B65H 75/4484; B65H 2701/32

USPC ..... 114/244–247, 253, 254, 312, 326, 328, 114/337, 338; 242/412.1, 412.2, 412.3, 242/557, 563

See application file for complete search history.

(56) References Cited

U.S. PATENT DOCUMENTS

| | | | | |
|---|---|---|---|---|
| 3,168,261 | A * | 2/1965 | Hainer | 242/390.6 |
| 3,589,643 | A * | 6/1971 | Takizawa | 242/482.9 |
| 5,370,074 | A * | 12/1994 | Knudsen et al. | 114/312 |
| 5,551,545 | A * | 9/1996 | Gelfman | 191/12.2 A |
| 6,167,831 | B1 * | 1/2001 | Watt et al. | 114/322 |
| 6,411,565 | B1 * | 6/2002 | Sirmalis et al. | 367/131 |
| 6,988,854 | B2 * | 1/2006 | Porter | 405/165 |

(Continued)

OTHER PUBLICATIONS

"International Search Report", mailed Dec. 6, 2012, PCT/US2012/048365.

*Primary Examiner* — Ajay Vasudeva

(74) *Attorney, Agent, or Firm* — Ingrassia, Fisher & Lorenz PC

(57) ABSTRACT

A cable containing an optical fiber is used to transmit data between an underwater remotely operated vehicle (ROV) and a support vessel floating on the surface of the water. The ROV stores the cable on a spool and releases the cable into the water as the ROV dives away from the support vessel. The ROV detects the tension in the cable and the rate that the cable is released from the ROV is proportional to the detected tension in the cable. After the ROV has completed the dive and retrieved by the support vessel, the cable can be retrieved from the water and rewound onto the spool in the ROV.

18 Claims, 5 Drawing Sheets

(56) References Cited

U.S. PATENT DOCUMENTS

| | | | | |
|---|---|---|---|---|
| 7,252,046 | B1 | 8/2007 | Ead et al. | 114/254 |
| 7,331,436 | B1 * | 2/2008 | Pack et al. | 191/12.2 A |
| 8,369,673 | B2 * | 2/2013 | Hawkes et al. | 385/123 |
| 8,556,538 | B2 * | 10/2013 | Hawkes et al. | 405/158 |
| 8,616,805 | B2 * | 12/2013 | Hawkes et al. | 405/158 |
| 2007/0022935 | A1 | 2/2007 | Griffith et al. | 11/312 |
| 2011/0162573 | A1 * | 7/2011 | Race et al. | 114/328 |
| 2012/0328372 | A1 * | 12/2012 | Hawkes et al. | 405/177 |

* cited by examiner

INTERNAL WINCH FOR SELF PAYOUT AND RE-WIND OF A SMALL DIAMETER TETHER FOR UNDERWATER REMOTELY OPERATED VEHICLE

CROSS REFERENCE TO RELATED APPLICATIONS

This application claims priority to U.S. Provisional Patent Application No. 61/512,537, "Internal Winch For Self Payout And Re-Wind Of A Small Diameter Tether For Underwater Remotely Operated Vehicle," filed Jul. 28, 2011. The entire contents of U.S. Patent Application No. 61/512,537 are hereby incorporated by reference.

BACKGROUND

With reference to FIG. 1, remotely operated underwater vehicles (ROV's) 101 are, widely used by industry and science for unmanned undersea work tasks. Some ROVs 101 require an electromechanical cable connection (tether) 105 to the surface for communications, power and vehicle recovery, which are typically located on a boat 109. These cables 105 are thick and heavy because they contain the required electrical conductors to provide power to the ROV 101. As the ROV 101 moves away from the boat 109, the tether 105 is released from a tether storage device 111.

In order to control the movement, the thrust 115 produced by the propulsion device 113 on the ROV 101 must be greater than the tension in the cable 105. The tension on the cable 105 is generated by drag on the cable due to the movement of the cable 105 through the water. The total tension can be proportional to the wetted surface area of the cable 105. Thus, more tension exists in the cable 105 and more thrust is required as the ROV 101 travels farther from the ship 109. This can be problematic because cables 105 can be damaged when the tension exceeds a certain force. What is needed is an alternative system that prevents the over tensioning of the cable 105.

SUMMARY OF THE INVENTION

The present invention is directed towards a system for preventing over tensioning of the cable tether between an ROV and a support ship. As the ROV travels away from the support ship, the ROV emits a thin optical cable. In an embodiment, the cable is pulled from the ROV by the tension from the cable or alternatively, the cable can be physically emitted from the ROV. Thus, the optical cable can be substantially stationary in the water while the ROV travels through the water. The ROV can have a tension sensor, a velocity sensor, an optical cable storage mechanism and a feeding system for releasing the optical cable from the ROV.

Various different types of cables can be used with the cable release mechanism. In an embodiment, the cable that only includes an optical fiber which can be used to transmit data between a battery-powered ROV and the support ship. The optical fiber can be encased in a plastic sheath that is surrounded by a high strength Kevlar sleeve. The cable can also include an abrasion resistant external coating which can be made of a high strength elastic material such as urethane. This optical fiber cable can be about 2.90 mm in diameter. In other embodiments, the optical fiber cable may only include the optical fiber without the high strength Kevlar sleeve. Although, the raw optical fiber cable can be much more fragile than the Kevlar sleeve cable, it can have a diameter of about 0.254. Thus, a spool containing a length of raw optical fiber cable will be much smaller than a spool containing an optical fiber cable having a Kevlar jacket an may be more suitable for certain types of applications.

If the ROV moves through the water without releasing the cable, the cable can be exposed to excess tension and the optical fiber can be damaged resulting in a communications failure. In order to prevent over tensioning the cable, the ROV can include a system which includes a cable storage unit, a cable tension sensor, a microprocessor and a cable release mechanism. The cable tension measurements can be converted into electrical signals which are transmitted from the tension sensor to the microprocessor. If the tension signal from the tension sensor exceeds a predetermined working tension of possibly 0.1-3.0 pounds, the microprocessor can cause the cable release mechanism to increase the rate at which the cable from the cable storage unit which can be a spool wrapped with the optical cable. The cable release can be reduced when the cable tension drops below a minimum tension which can be about 0.1 pounds.

In another embodiment, the ROV can also include one or more speed sensors which can transmit speed signals to the microprocessor. The sensors can determine how fast the ROV is traveling through the water and based upon this information, the microprocessor can cause the release mechanism to release the cable at a rate that is equal to or faster than the speed of the ROV. The cable release mechanism on the ROV can allow the ROV to travel deeper and farther away from the support ship which can greatly enhance the ability of the ROV to perform the required tasks.

DETAILED DESCRIPTION

Figure 1:
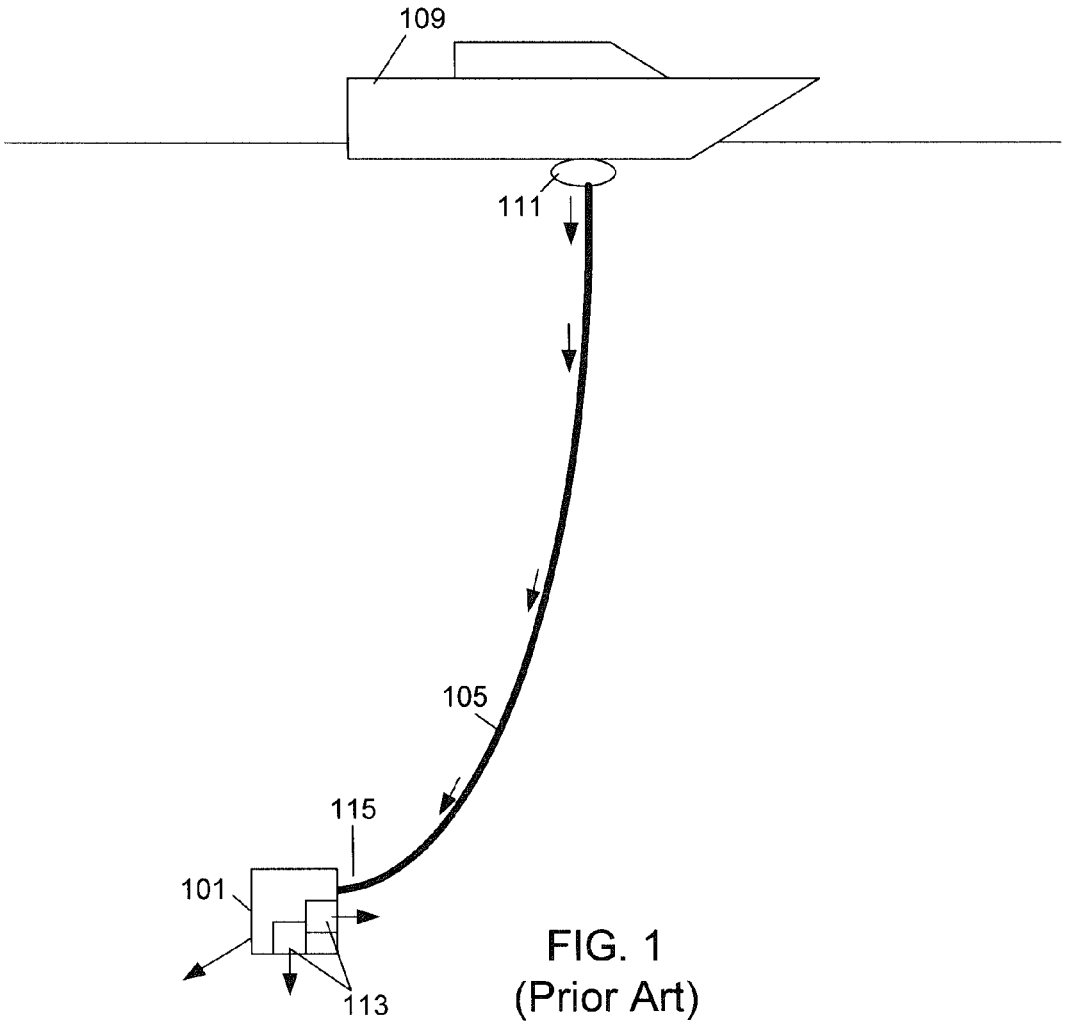
FIG. 1 (Prior Art)
FIG. 1 illustrates a diagram of a ROV.

The present invention is directed towards a system for storing and releasing an optical fiber cable that extends between an ROV and a support ship. ROVs typically require a tether cable to connect the undersea vehicle with the surface supplied electrical power so have power conductors in their tether cable together with a communications link which are typically fiber optic cables and steel wires to allow recovery. Alternatively, ROVs can be battery-powered, typically using rechargeable lithium battery packs. Such ROVs are able to use very small diameter armored fiber optic cable which can be about 1-3 mm in diameter for high bandwidth two way communications for command and control as well as to transmit sensor data such as HD video signals from vehicle to the surface. In an embodiment, the optical fiber cables can be about 2.9 mm in diameter or any other diameters less than about 5.0 mm.

Typically the ROV cable is held on a spool or a winch on the surface ship. The cable can be released from the surface ship into the water where it is dragged by the ROV through the water to the depth and distance required. Such dragging of the cable through water causes both skin friction and form drag which on long lengths of cable can generate sufficient force to overwhelm the maximum thrust capability of the ROV propulsion system. Hence, surface deployment of the tether creates drag forces on the tether and limits the practical depth and/or range that ROVs can be used.

The present invention includes ROVs that use small diameter armored optical fiber cables that are stored aboard and released from the ROV rather than from the surface ship. The ROV cable release system can include a tension sensor which can be coupled to drive motor which cause the cable to pay out from a storage spool as the vehicle moves through the water. Thus, the cable is not dragged but can be effectively stationary in the water where the ROV has travelled through. Since the cable is only pulled with a minimum tension through the water and the optical fiber cable generates almost no drag on the ROV. Thus, the ROV is freed from cable drag forces and it can move much more freely through the water. Because the cable drag has been effectively eliminated, the ROV is able to travel to greater depth and for longer ranges with less propulsion power required.

In an embodiment, the present inventive system can use substantially neutrally buoyant armored fiber optic cables with battery-powered ROVs. The neutral buoyancy causes the released cable to be substantially stationary in the water after it is released from the ROV. The neutral buoyancy also prevents the cable from floating or sinking quickly. This up or down cable movement would result in unwanted cable tension on the ROV. Because the cable drag has been eliminated, the ROV using the inventive system can be designed to operate at depths that exceed 7,000 meters and ranges that exceed 20,000 meters. These depths and ranges are many times greater than what has been proven possible with ROVs using surface-deployed cables which are released from the support ship and dragged through the water by the ROV.

Figure 2:
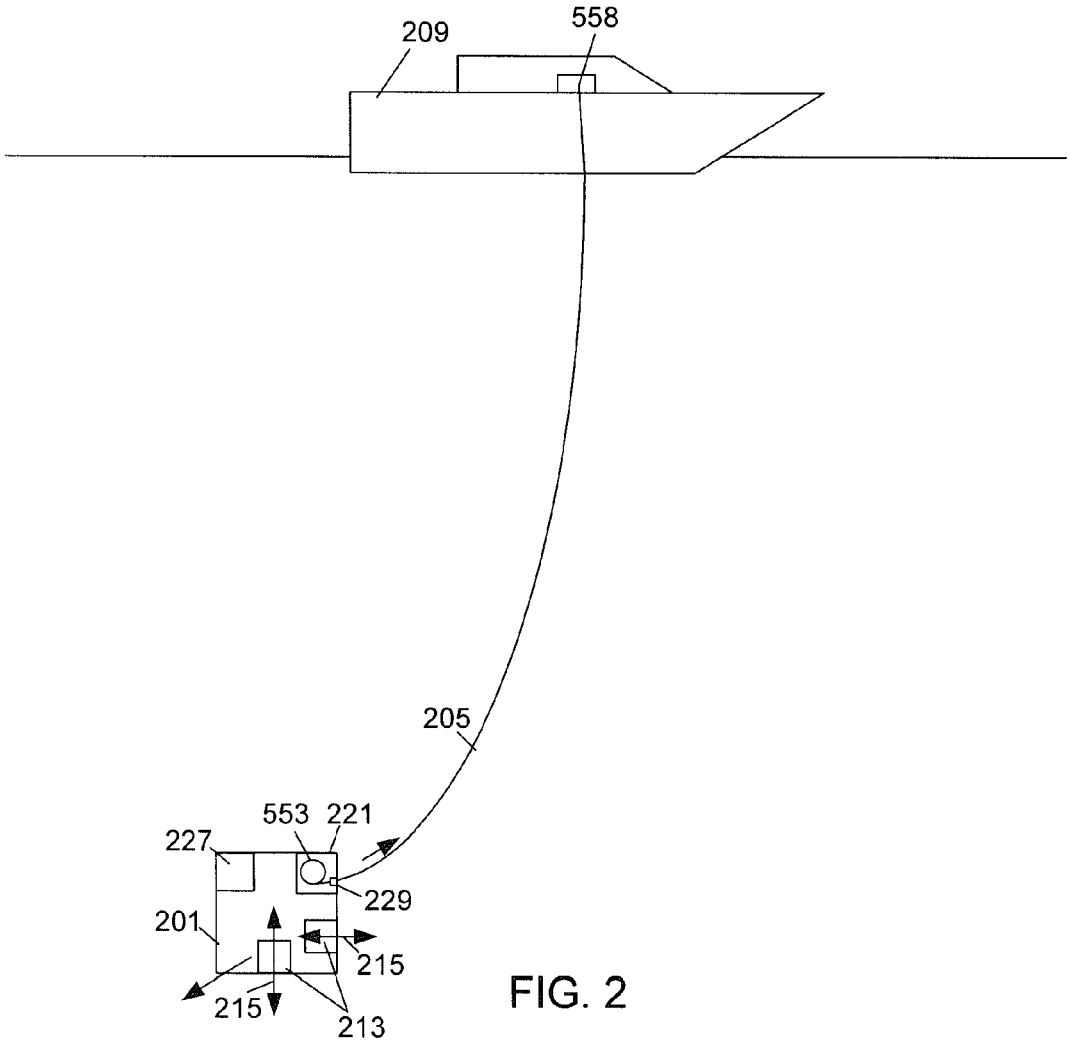
FIG. 2 illustrates a diagram of a ROV with a cable tension control mechanism.

With reference to FIG. 2 a simplified drawing of an ROV 201 is illustrated. The cable 205 can be stored on a cable release mechanism 221 on the ROV 201. As the ROV 201 travels away from the support ship 209, the tension sensor 229 detects tension in the cable and the cable 205 can be released from a spool 553 in the release mechanism 221. The cable 205 may not be stored on the support ship 209 or possibly a short length of the cable 205 can be stored on the support ship 209 and released into the water when the ROV 201 initially placed into the water and before travels away from the ship 209.

During normal operations, the cable 205 stored on the spool 553 in the ROV 201 can be released as the ROV 201 moves through the water. The ROV 201 can move in any direction in the water by using horizontal and vertical thrust 215 to move the ROV 201 through the water. As the ROV 201 travels away from the support vessel 209, the cable 105 is released and therefore it is not pulled through the water. Thus, the propulsion system 213 only needs to produce enough thrust 215 to overcome the hydrodynamic drag forces on the ROV 201 and possibly a small amount of tension from the cable 205 which can be less than about 3 pounds of force. Since the cable 205 is not being pulled through the water, the propulsion system 213 of the ROV 201 does not have any significant added drag forces which would be present if the cable 205 was being pulled through the water. The cable 205 can maintain an optical transmission path between the ROV 201 and a controller or communications device 558 on the support vessel 209.

In order to minimize the tension on the cable 205, the system can release the cable 205 at a rate that is greater than or equal to the speed of the ROV 201 through the water. In an embodiment, the ROV 201 may also include a speed sensor 227 which is coupled to the cable release mechanism 221. As the ROV 201 moves, the speed sensor 227 can detect the movement and the cable release mechanism 221 can begin to release cable 205 at a speed equal to or even slightly greater than the velocity of the ROV 201 through the water. The ROV 201 can move in any path while leaving the cable 205 in the water. Because the system will normally keep the tension in the cable 205 to a nominal level, the cable tension should always be well below the maximum working tension. If the cable 205 is not released at a rate close to the speed of the ROV 201, the cable 205 can be pulled by the ROV 201 creating tension in the cable 205. The path of the ROV should also be controlled to prevent loops or over lapping routes that may cause the released cable 205 to become tangled.

After the ROV 201 travels a significant distance from the support ship 209, there can be a significant amount of exposed cable 205 in the water. There can be some isolated areas of tension in the cable 205 that has been released into the water due to movement of the support ship or variations in water current at different depths or due to traversing "tide lines." The amount of tension in the cable 205 can vary along the exposed length of cable 205. However, since these non-uniform current movements can be minimal, the expected cable 205 tension caused by the support ship 209 and water movement should be nominal and well below the safe maximum operating tension of the cable 205 which might be about 50-75 pounds. This cable tension may be isolated to certain regions of the cable 209. However, the cable 205 tension can also be transmitted to the ROV where it can be detected by the tension sensor 229 in the ROV 201. When cable tension is detected, the system will release additional cable 205 from the ROV 201 to reduce the tension.

Figure 3:
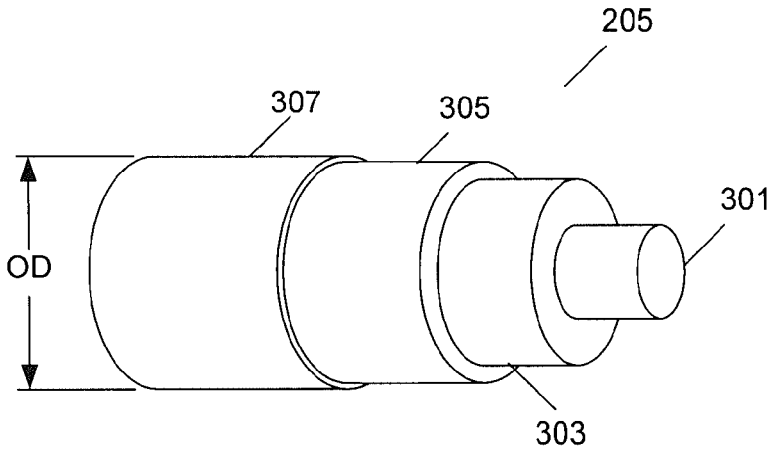
FIG. 3 illustrates a view of an optical cable.

With reference to FIG. 3, an embodiment of a typical fiber optic cable 205 is illustrated. The cable 205 can have a center single-mode optical fiber 301 encased in a plastic sheath 303 surrounded by a high strength jacket member 305 which can be made of a high strength composite fiber such as Kevlar. The high strength jacket member 305 can be surrounded by an abrasion resistant external coating or layer 307 which can be made of urethane or other similar materials. Such cables 205 are becoming standard with outside diameter (OD) that is approximately 2.9 mm. Although the Kevlar-strengthened small diameter cable 205 illustrated in FIG. 3, may not mechanically break until being loaded to 400 lbs or more, the optical fiber core 301 can be damaged if a tension above 70 lbs is applied to the cable 205. Thus, a small cable 205 may have a maximum safe working tension of about 50 lbs or less. In other embodiments, the cable 205 OD can be between about 1.0 and 5.0 mm and the strengths of these cables may have a maximum working strength that is less than or greater than 50 lbs. These cables 205 can be used with subsea remote vehicles where the high strength, toughness and abrasion resistance are needed to survive harsh environments.

In other embodiments, the optical cable used with the inventive cable deployment system may not have the protective structures described in FIG. 3. In this embodiment, the same long and deep dives can be achieved using a raw optical cable which can have an outer diameter of about 0.254 mm. The optical fiber can be stored aboard the vehicle and released through the inventive release system as described. This thinner raw cable can occupy substantially less space than the armored optical cable but will also have a much lower maximum working tensile strength. However, since the cable is exposed to a minimal amount of tension, the raw thin cable can operate in the described matter without the extra strength provided by the Kevlar jacket. The raw optical cable is further described in U.S. patent application Ser. No. 12/795,971, "Ocean Deployable Biodegradable Optical Fiber Cable" which is hereby incorporated by reference.

Figure 4:
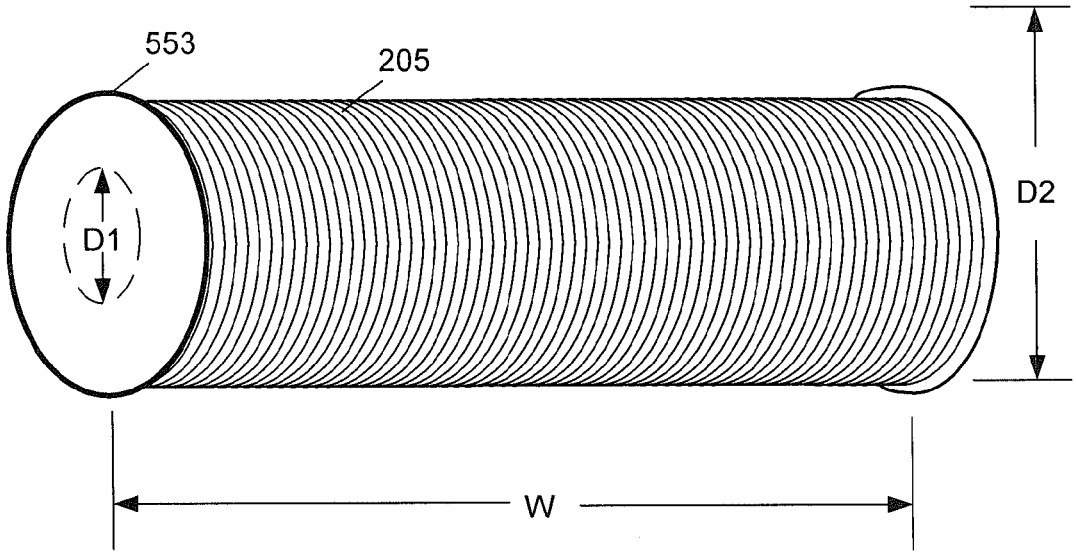
FIG. 4 illustrates a view of an optical cable spool.

With reference to FIG. 4, this small diameter fiber optic cable 205 that can be wound on a drum inside the ROV 201.

For example, a 20,000 ft long 2.9 mm cable 205 can be wound on a spool 553, a drum or other structure in the ROV. In an exemplary embodiment, the spool 553 can have an outer diameter (D1) that is about 10 cm and a width (W) of about 200 cm wide. The cable 205 can be wrapped on the spool 553 in a repeating spiral pattern onto the spool 553 so that there are about 42 layers. The equation for estimating the length of cable 205 stored on the spool 553 can be calculated by the question.

Cable length=(average circumference)×(number of layers)×(number wraps/layer)

$D2=D1+2\times$number of layers×OD of cable

Average circumference=$\pi\times(D1+D2)/2$

Number of wraps per layer=$W$/(OD of cable)

First Exemplary Embodiment

OD of cable=0.29 cm
Number of layers of cable on spool=42
Outer diameter of spool (D1)=10 cm
Width of spool (W)=200 cm Outer diameter of spool and cable ($D2$)=10 cm+2×42×0.29 cm=34.36 cm Average circumference of cable on spool=$\pi\times$(10 cm+34.36 cm)/2=69.68 cm Number of wraps per layer=200 cm/0.29 cm=690

Length of cable stored on spool=(70 cm)×42×690=2,028,600 cm=20,286 meters

Second Exemplary Embodiment

OD of cable=0.0254 cm
Number of layers of cable on spool=30
Outer diameter of spool (D1)=10 cm
Width of spool (W)=50 cm Outer diameter of spool and cable ($D2$)=10 cm+2×30×0.0254 cm=11.52 cm Average circumference of cable on spool=$\pi\times$(10 cm+11.52 cm)/2=33.80 cm Number of wraps per layer=50 cm/0.0254 cm=1,968

Length of cable stored on spool=(33.02 cm)×30×1,968=1,949,501 cm=19,495 meters

Figure 5:
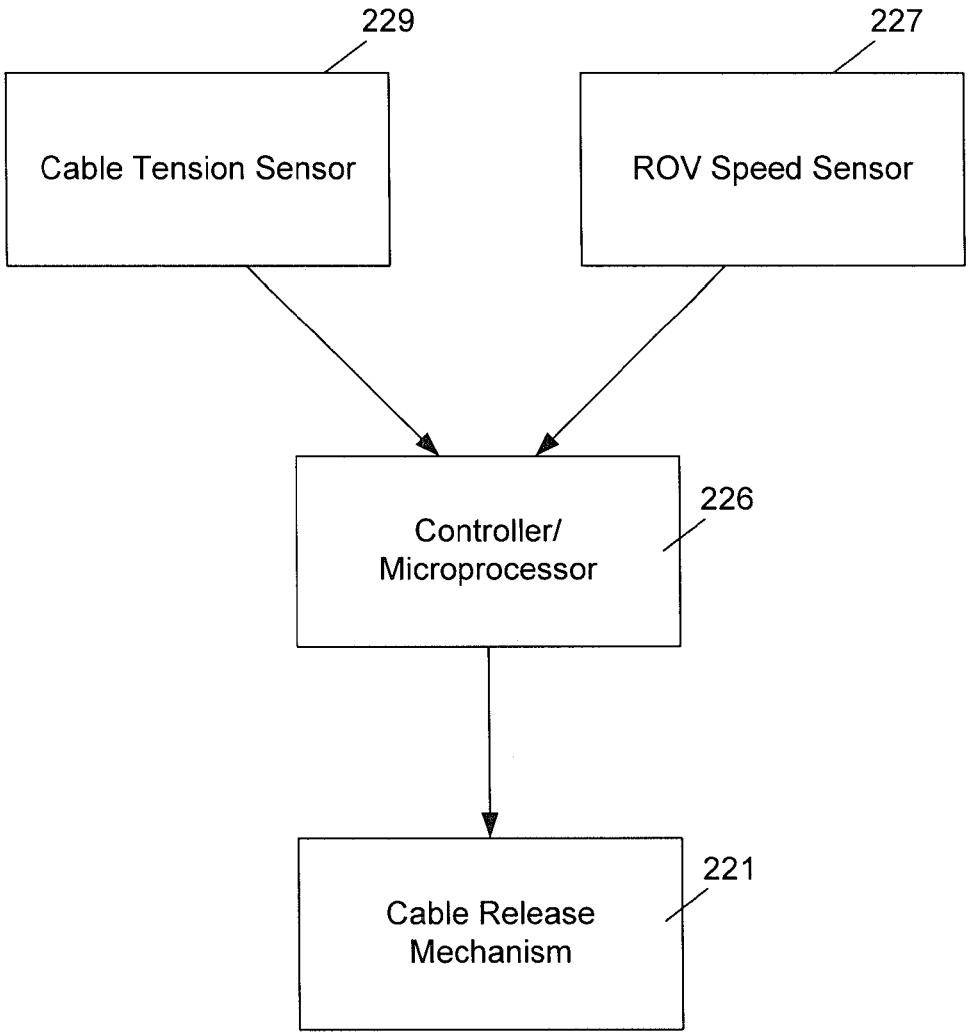
FIG. 5 illustrates block diagram of the optical cable tension control mechanism components.

With reference to FIG. 5, a block diagram of the cable release system components is illustrated. In order to eliminate cable tension, the ROV 201 can detect the cable tension through a cable tension sensor 229 which detects the cable tension as it exits the ROV. The tension sensor 229 can transmit a tension signal to the controller/microprocessor 226. If the controller/microprocessor 226 detects that the tension has exceeded a predetermined value such as a nominal working tension, the controller/microprocessor 226 can transmit a signal to the cable release mechanism 221 to release the stored cable at a first rate or speed. As discussed, the cable release mechanism can include a spool that the cable is stored on. To release the cable, the cable release mechanism can include a motor which causes the spool to rotate and release the cable from the ROV. The speed at which the controller/microprocessor 226 causes the cable release mechanism 221 to release the cable can be proportional to the tension in the cable detected by the cable tension sensor 229. In an embodiment, the cable tension should decrease as the cable is released from the cable release mechanism. However, if the tension sensor 229 continues to detect cable tension, the controller/microprocessor 226 can transmit signals to the cable release mechanism 221 to increase the rate that the cable is released. Once the tension drops to a normal working level the controller/microprocessor 226 can transmit signals to the cable release mechanism 221 to reduce the rate at which the cable is released. By monitoring the cable tension and releasing the cable at a speed that is proportional to the tension, the cable tension can be kept to a nominal level and the ROV can travel without any significant drag due to cable tension.

In an embodiment, the cable release mechanism 221 can be configured to maintain the cable tension at any predetermined tension. For example, if the cable release mechanism 221 is set to a predetermined tension of 1 lb. of force or a normal working tension of 0.8 to 1.2 pounds, the cable tension sensor 229 can monitor the tension of the cable and transmit the cable tension data to the controller/microprocessor 226. The controller/microprocessor 226 can control the cable release mechanism 221 to release cable at a steady first rate, for example 10 cm per second. If the tension rises above 1.2 lb force, the controller/microprocessor 226 can increase the cable output rate above 10 cm per second until the cable tension is reduced to 1 lb force. For example, cable output may be increased to 16 cm per second at which speed the cable tension drops to 1.0 pounds. The controller/microprocessor 226 can maintain this higher cable output if the cable tension is held within the predetermined range. Conversely, if the cable tension decreases below 0.8 pound force, the controller/microprocessor 226 can decrease the output rate of the cable until the cable tension increases to the normal working range. By constantly monitoring and adjusting the output speed, the cable can be maintained in its normal working tension.

In an embodiment, the ROV may also detect the speed of the ROV with a ROV speed sensor 227. The speed signals from the ROV speed sensor 227 can also be transmitted to the controller/microprocessor 226 which can then control the cable release mechanism to release the cable at a rate that matches or is slightly greater than the speed of the ROV. As the ROV accelerates through the water, the speed sensor 227 will detect the increased speed and transmit this information to the controller/microprocessor 226 which can increase the cable release rate from the cable release mechanism. Conversely, if the ROV slows down, the slower speed can be transmitted to the controller/microprocessor 226 which can reduce the cable release rate from the cable release mechanism 221. In an embodiment, the speed sensors 227 may only detect the speed of the ROV in a single direction. Thus, the ROV may require multiple speed sensors 227 which are aligned in different directions. For example, a first speed sensor 227 may only detect vertical velocity while a second speed sensor may only detect horizontal velocity. The controller/microprocessor 226 may need to calculate a cumulative ROV speed based upon the multiple speed signals. The cumulative velocity may be represented by the formula $V_{cumulative}^2=V_{vertical}^2+V_{horizontal}^2$. The controller/microprocessor 226 can then control the output rate from the cable release mechanism 221 to match or be slightly faster than the ROV speed.

In an embodiment, the controller/microprocessor 226 can use a combination of speed detection from the speed sensor 227 and cable tension from the tension sensor 229 to control the cable output speed from the cable release mechanism 221. In this embodiment, the controller/microprocessor 226 can start emitting cable at a speed that approximately matches the ROV speed from the speed sensor 227. If additional tension is detected above the normal working range from the tension sensor 229, the controller/microprocessor 226 cause the cable release mechanism to increase the rate at which the cable is released. If the tension drops to the normal working range, the controller/microprocessor 226 can resume releasing the cable at or slightly above the speed of the ROV. If the tension drops below the normal working range, the controller/microprocessor 226 can either maintain releasing the cable at the ROV speed or decrease the speed that the cable is released.

The cable 205 can continue to be released from the ROV until the stored cable 205 is depleted. However, this may problematic because the lack of cable 205 on the ROV can prevent the ROV from traveling any further without inducing tension into the cable. In an embodiment, the cable release mechanism 551 can transmit signals to indicate the quantity of cable 205 remaining on the spool 553. The cable release mechanism 551 may be able to determine the length of cable 205 released by counting the number of rotations of the spool 553 when the cable 205 is released. Thus, if necessary, an operator of the ROV 201 can transmit a signal from the support vessel to cut the mission of the ROV 201 short or have the ROV 201 surface for retrieval. These steps can prevent the ROV 201 from running out of or damaging the cable 205.

Figure 6:
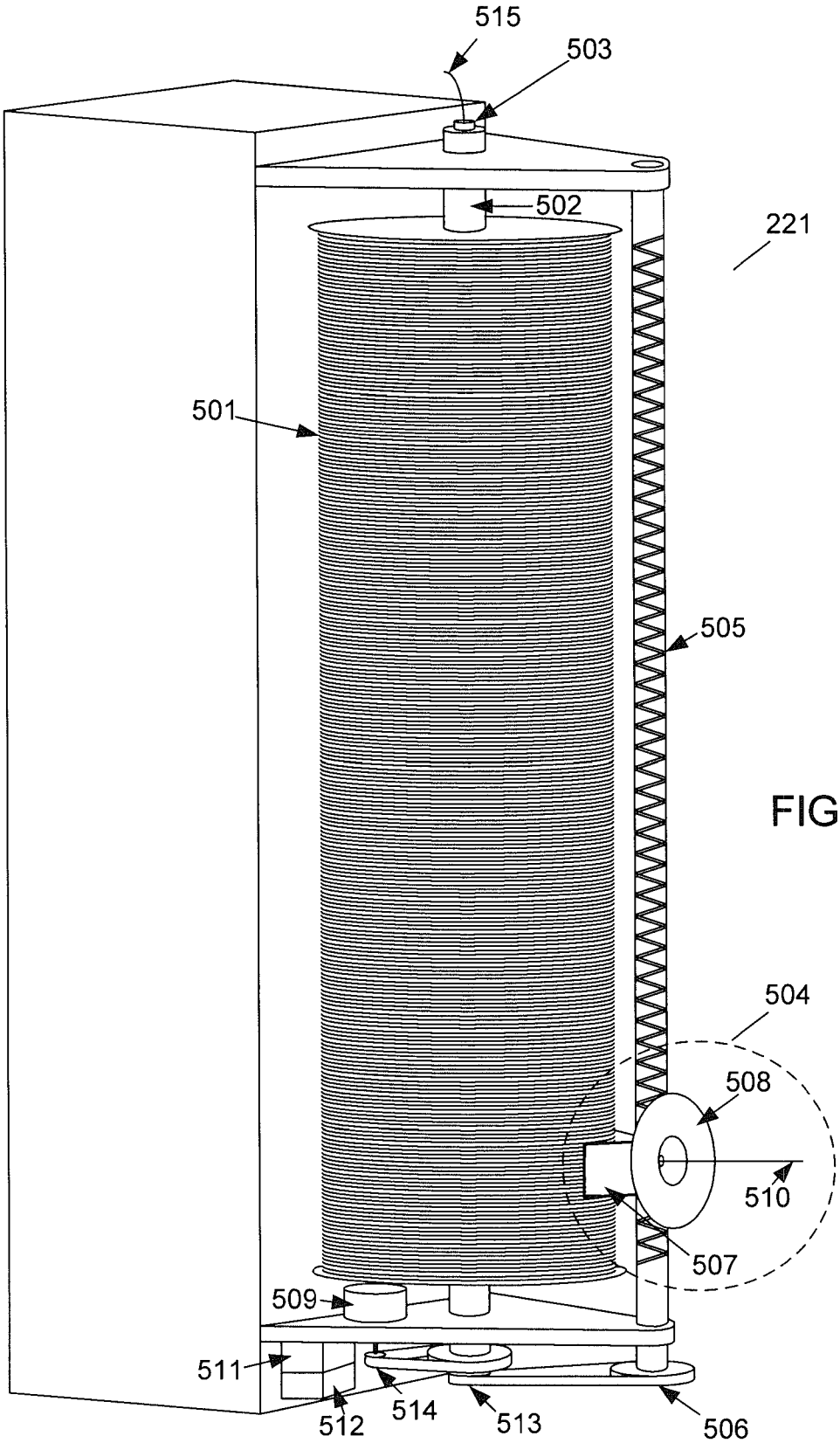
FIG. 6 illustrates an embodiment of a cable release mechanism.

With reference to FIG. 6, an embodiment of the cable release mechanism 221 is illustrated. In this embodiment, a spool 501 can be wrapped with a long continuous length of optical cable 510. The spool 501 can be coupled to a drive shaft 502 which allows the spool 501 to rotate. One end of the optical cable 510 can be coupled to a rotary optical joint 503 to allow the spool 501 and optical cable 510 to rotate and maintain an optical communications path through the cable 510. An optical cable 515 can be coupled to the opposite side of the rotating optical joint 503 which is connected the controller on the ROV.

The spool 501 rotates to release the cable 510 which can be fed through a cable tension sensor 507 which detects the tension of the cable 510 as it leaves the ROV. The cable can also be fed through a guide 508 which can be a smooth bell mouth which has a curved guide surface having a radius that prevents the cable 510 from being bent at a sharp angle that may damage the cable 510 as it exits the cable release mechanism 221. Because the surfaces of the guide 508 are smooth, the sliding of the cable 510 against the guide 508 does not produce any significant friction.

The guide 508 can be coupled to a reversing lead screw 505 which is part of a level winding system 504. The reversing lead screw 505 can be can be coupled to a belt driven lead screw pulley 506 which is coupled to a spool pulley 513 attached to the drive shaft 502. The drive motor 509 can rotate a pinion gear which can be connected to the spool pulley 513 with a drive belt. When the controller 511 causes the drive motor 509 to rotate, the pinion gear 514 rotation causes the spool pulley 513 to rotate which spins the spool 501 to release the cable 510. The spool pulley 513 also rotates the lead screw pulley 506 which causes the guide 508 to move back and forth across the width of the spool 501 to match the position of the cable 510 being removed from the spool 501. In an embodiment, the level wind system 504 can use a reversing lead screw 505 with a belt drive that rotates at about ¼ the winch drum speed. The lead screw pulley 506 may have interchangeable belt drive sprockets so that the winding angle can be changed to suit different diameter cables. In the preferred embodiment, the winding pitch of the cable is an open "universal" wind where the cable pitch is ¼ of the reversing lead screw pitch.

The cable 510 can be released from the cable release mechanism 221 in various different modes of operation. In an embodiment, the payout method is to monitor the tether tension from the tension sensor 507 at the ROV as the ROV moves through the water. The tension sensor 507 can transmit tension signals to the controller 511 and microprocessor 512. If the tension is too high, the controller 511 and microprocessor 512 can control the drive motor 509 to unwind or payout the cable 510 to maintain a constant, small tension that is within the predetermined normal operating tension range. For example, when the tether 510 tension tugs gently on the ROV of about 1 lb of force, the controller 511, microprocessor 512 and drive motor 509 function together to release the tether 510 as required to automatically maintain the 1 lb±0.5 lb. force tension. As also discussed, the controller 511 and microprocessor 512 can be in communication with speed sensors to control the drive motor 509 to release the cable 510 at a rate that is greater than or equal to the speed of the ROV through the water.

In addition to releasing the cable, the cable release mechanism 221 can be used to retrieve the cable 510 that has been released from the ROV. When the ROV is retrieved by the support vessel, the cable 510 can still extend from the ROV. The cable release mechanism 221 can be reversed to retrieve the cable 510 to the spool 501. The same cable tension control system can be used when the cable 510 is being re-wound onto the spool 501. The motor 509 can be powered in a reverse direction by the controller 511 that is controlled by the microprocessor 512 based upon tension feedback from the tension sensor 507 in order to automatically control the cable 510 tension. The drive motor 509 can cause the spool 501 to rotate and wrap the cable 510 back onto the spool 501. If the tension rises above a predetermined retrieval force the motor 509 can slow the rotation of the spool 501. In the cable retrieval mode, the cable 510 is being dragged through the water, so drag forces on the cable 510 can be proportional to the length of the cable 510 in the water. If the cable tension exceeds the normal retrieval working tension range, the motor 509 can slow to reduce the retrieval speed and reduce the tension. Conversely, if the tension is below the normal retrieval tension range, the motor 509 can be controlled to increase the rate of rotation of the spool 501.

The level wind system 504 can cause the guide 508 to move back and forth across the spool 501 so that the cable 510 is wound evenly onto the spool 501. The wind angle of the cable 510 on the spool 501 should be sufficient to prevent top layers of cable 510 from burying into underlying cable 510 wraps. Although, the rewind system is illustrated as a motor drive system, in other embodiments, it is possible to have a mechanical lever attached to the drive shaft 502 so that the cable 510 can be retrieved by manually turning the drive shaft 502.

It will be understood that the inventive system has been described with reference to particular embodiments, however additions, deletions and changes could be made to these embodiments without departing from the scope of the inventive system. Although the systems that have been described include various components, it is well understood that these components and the described configuration can be modified and rearranged in various other configurations.

What is claimed is:

1. A cable release apparatus comprising:

an optical cable for transmitting data between a controller on a surface vessel and a remotely operated underwater vehicle, the cable having a neutral buoyancy that prevents the optical cable from floating or sinking quickly;

a spool mounted on the remotely operated underwater vehicle for storing substantially all of the optical cable, the remotely operated underwater vehicle including a propulsion system which produces vertical thrust;

a release mechanism that controls the removal of the optical cable from the spool into the ambient water;

a cable tension sensor for detecting tension in the optical cable;

a speed sensor for detecting speed of the remotely operated underwater vehicle; and a controller in communication with the cable tension sensor and the speed sensor for controlling the release mechanism;

wherein the controller controls the release mechanism to adjustably release the optical cable from the spool at a speed that is based on and proportional to a combination of the speed of the remotely operated underwater vehicle and the tension in the optical cable so that the tension in the optical cable is maintained within a predetermined range.

2. The apparatus of claim 1 wherein the predetermined value is greater than about 0.5 pound of tension and less than about 2.0 pounds of tension.

3. The apparatus of claim 1 wherein the outer diameter of the optical cable is between 1.0 and 5.0 mm.

4. The apparatus of claim 3 further comprising:

a drive motor coupled to the tension sensor for rotating the spool in a first direction to release the optical cable from the spool and maintain the optical cable at a tension that is less than about 2.0 pounds.

5. The apparatus of claim 4 wherein the drive motor rotates the spool in a second direction opposite the first direction to retrieve the optical cable that has been released onto the spool.

6. The apparatus of claim 1 wherein the cable is not stored on the surface vessel.

7. The apparatus of claim 1 wherein the rate that the optical cable is removed from the spool at approximately the speed of the remotely operated underwater vehicle through the water.

8. The apparatus of claim 1 further comprising:

a feeder for guiding the cable from the spool to assist in releasing the optical cable from the remotely operated underwater vehicle.

9. The apparatus of claim 8 wherein the feeder includes a lead screw for moving the feeder across a portion of the spool.

10. A cable release apparatus comprising:

an optical cable for transmitting data between a controller on a surface vessel and a remotely operated underwater vehicle, the cable having a neutral buoyancy that prevents the optical cable from floating or sinking quickly;

a spool mounted on the remotely operated underwater vehicle for storing substantially all of the optical cable, the remotely operated underwater vehicle including a propulsion system which produces vertical thrust;

a cable tension sensor for detecting tension in the optical cable;

a speed sensor for detecting speed of the remotely operated underwater vehicle; and a controller in communication with the cable tension sensor and the speed sensor, the controller adjustably controlling a release mechanism on the remotely operated vehicle based on a combination of signals transmitted by the speed sensor and the cable tension sensor;

wherein the optical cable is released into ambient water from the spool by the release mechanism at a speed that is proportional to the speed of the remotely operated underwater vehicle and the tension in the optical cable so that the tension in the optical cable is maintained within a predetermined range.

11. The apparatus of claim 10 wherein the predetermined value is greater than about 0.5 pound of tension and less than about 2.0 pounds of tension.

12. The apparatus of claim 10 wherein the outer diameter of the optical cable is between 1.0 and 5.0 mm.

13. The apparatus of claim 12 further comprising:

a drive motor coupled to the tension sensor and the controller for rotating the spool in a first direction to release the optical cable from the spool;

wherein the controller causes the drive motor to rotate the spool to maintain the raw optical cable at a tension that is less than about 2.0 pounds.

14. The apparatus of claim 13 wherein the drive motor rotates the spool in a second direction opposite the first direction to retrieve the optical cable that has been released onto the spool.

15. The apparatus of claim 10 wherein the optical cable is not stored on the surface vessel.

16. The apparatus of claim 10 wherein the rate that the optical cable is removed from the spool at approximately the speed of the remotely operated underwater vehicle through the water.

17. The apparatus of claim 10 further comprising:

a feeder for guiding the optical cable from the spool to assist in releasing the optical cable from the remotely operated underwater vehicle.

18. The apparatus of claim 17 wherein the optical cable stored on the spool is greater than 1,000 meters in length and the diameter of the cable is between 1.0 and 5.0 mm.

* * * * *